US007367810B2

(12) United States Patent
Lee et al.

(10) Patent No.: US 7,367,810 B2
(45) Date of Patent: May 6, 2008

(54) CABLE CONNECTOR FOR SELECTIVE WIRING

(75) Inventors: Hwan-Gyu Lee, Seongdong-gu (KR); Shin-Hoe Kim, Seo-gu (KR)

(73) Assignee: Agency for Defense Development (KR)

( * ) Notice: Subject to any disclaimer, the term of this patent is extended or adjusted under 35 U.S.C. 154(b) by 0 days.

(21) Appl. No.: 11/590,921

(22) Filed: Nov. 1, 2006

(65) Prior Publication Data

US 2007/0105434 A1 May 10, 2007

(30) Foreign Application Priority Data

Nov. 2, 2005 (KR) ..... 10-2005-0104085

(51) Int. Cl.
*H01R 29/00* (2006.01)

(52) U.S. Cl. ..... 439/49

(58) Field of Classification Search ..... 439/49, 439/502

See application file for complete search history.

(56) References Cited

U.S. PATENT DOCUMENTS

| | | | | |
|---|---|---|---|---|
| 4,502,744 | A | 3/1985 | Garnett et al. | |
| 4,579,407 | A * | 4/1986 | Shimada | 439/502 |
| 5,293,013 | A | 3/1994 | Takahashi | |
| 5,430,618 | A * | 7/1995 | Huang | 361/818 |

* cited by examiner

*Primary Examiner*—Ross Gushi
(74) *Attorney, Agent, or Firm*—Banner & Witcoff, Ltd.

(57) ABSTRACT

The present invention relates to a strain gauge interfacing cable connector for selective wiring. A DIP switch 120 is disposed on a cable 110 of the cable connector, and electric wires and the DIP switch 120 are wired in a given arrangement. Accordingly, a variety of wiring systems can be implemented using a minimal number of electric wires through mechanical manipulation of the DIP switch 120 and minimal artificial wiring modification. The cable connector includes a cable 110 for containing a plurality of electric wires; a commercial connector 140; and a DIP switch 120 disposed on the cable 110 of a location adjacent to the commercial connector 140 of the cable, whereby a predetermined internal wiring can be switched by selectively manipulating switch control units 122 of the DIP switch 120 depending on a use.

1 Claim, 2 Drawing Sheets

CABLE CONNECTOR FOR SELECTIVE WIRING

BACKGROUND OF THE INVENTION

1. Field of the Invention

The present invention relates to a cable connector for selective wiring. More particularly, the present invention relates to a cable connector for selective wiring, wherein a DIP (Dual In-line Package) switch is disposed on a cable, and electric wires and the DIP switch are wired in a given arrangement, whereby a variety of wiring systems can be implemented through only mechanical manipulation of the DIP switch, or the manipulation of the DIP switch and minimal artificial wiring modification.

2. Background of the Related Art

For example, in strain measurement employing the strain gauge, the wiring method of the sensor (the strain gauge) and the measurement equipment (the signal amplifier) may include four kinds of wiring methods such as a quarter bridge wiring method using one strain gauge of 120Ω, a quarter bridge wiring method using one strain gauge of 350Ω, a half bridge wiring method using two strain gauges, and a full bridge wiring method using four strain gauges (or a strain gauge type transducer (such as a load cell or a pressure sensor) wiring method), as shown in FIG. 3.

In the four kinds of the wiring methods, however, the wirings between the signal line of the strain gauge and the measurement equipment are not the same as show in FIG. 3.

Therefore, in the cable connector between the measurement equipment and the sensor, a method of using a cable connector having a sufficient number of electric wires that can contain the entire wirings may be taken into consideration as one of the methods capable of accommodating the entire wirings. If this method is applied to a measurement system as shown in FIG. 3, however, a cable that contains seven electric wires is required. Furthermore, in the sensor connector, artificial wirings including jump wiring must be changed. Furthermore, in the case where the length of the cable is long because the distance between the measurement equipment and the sensor is far, if a system for mobile measurement it is non-economical in terms of cost. a problem arises because the size of the cable and the connector is big.

Meanwhile, in the wiring of the measurement equipment and the sensor, as another method capable of containing the entire measurement of FIG. 3, there is a method of fabricating cable connectors corresponding to the four kinds of FIG. 3 and using the cable connectors while replacing them depending on the use.

However, the method requires four cable connectors for one measurement channel. Accordingly, this method is disadvantageous in that it is non-economical in terms of the cost and work load and requires many cable connectors that must be managed.

SUMMARY OF THE INVENTION

Accordingly, the present invention has been made in view of the above problems occurring in the prior art, and it is an object of the present invention to provide a cable connector for selective wiring, in which a DIP switch is disposed on a cable adjacent to a commercial connector of the cable connector, and electric wires and the DIP switch are wired in a given arrangement, whereby a variety of wiring systems can be implemented using a minimal number of electric wires through mechanical manipulation of the DIP switch and minimal artificial wiring modification.

A cable connector for selective wiring according to an aspect of the present invention includes a cable for containing a plurality of electric wires; a commercial connector; and a DIP switch disposed on the cable of a location adjacent to the commercial connector of the cable, whereby a predetermined internal wiring can be switched by selectively manipulating switch control units depending on a use.

The cable connector may further include a jump wiring which could be operated simply by manipulation of DIP switch. Furthermore, the cable connector may further include a heat shrinkable tube with access window to fix and protect the DIP switch to the cable connector. arranged near the DIP switch and adapted to cover and protect portions of the cable and the DIP switch and cause the switch control unit to be exposed to the outside through a window.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1:
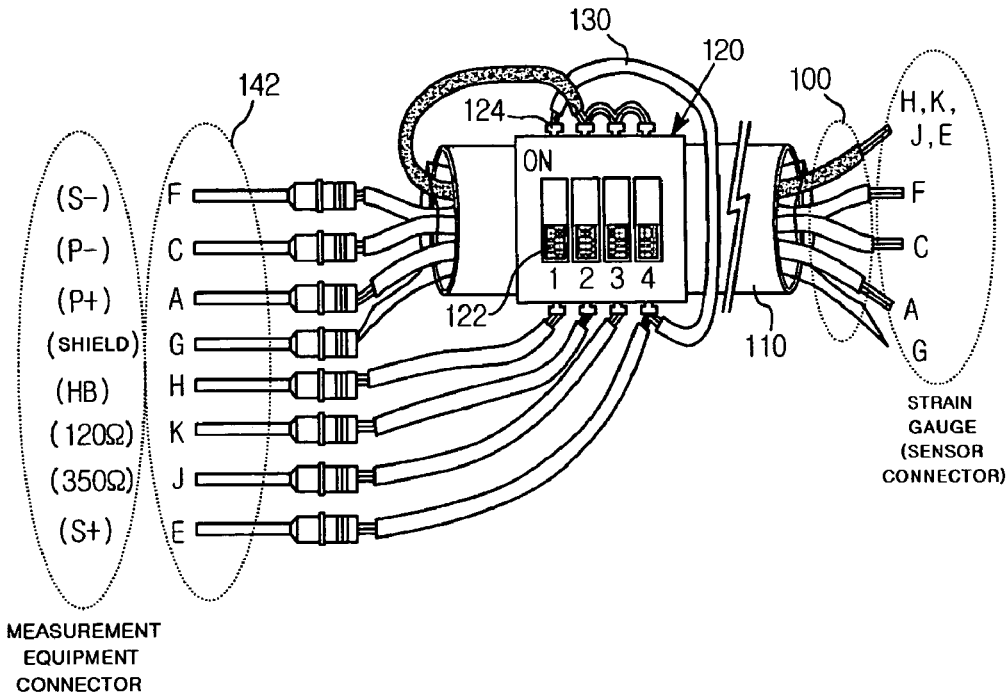
FIG. 1 shows an example of the structure of a cable connector for selective wiring according to an embodiment of the present invention and is a perspective view of a cable connector that connects a sensor and a measurement equipment.

FIG. 1 is a perspective view of a cable connector for selective wiring according to an embodiment of the present invention.

The cable connector according to an embodiment of the present invention may be applied to a strain measurement system, as shown in FIG. 1. The cable connector may be constructed to connect a strain gauge (or a sensor using the strain gauge such as a pressure transducer or a load cell) and a measurement equipment (a signal amplifier). The cable connector includes a cable 110 containing plural pieces of electric wires 100, and a DIP switch 120 arranged on the cable 110.

The DIP switch 120 shown in FIG. 1 is a commercial slide type 4-pole DIP switch. The DIP switch is constructed to form wiring in an "on" state and disconnects the wiring in an "off" state.

Figure 2:
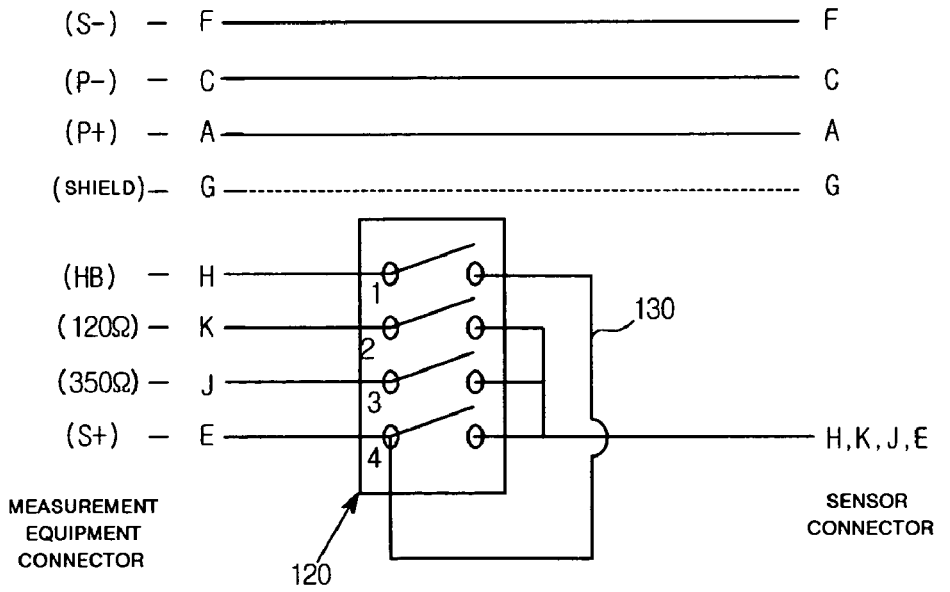
FIG. 2 is a circuit diagram illustrating a wiring state of FIG. 1.
Figure 3:
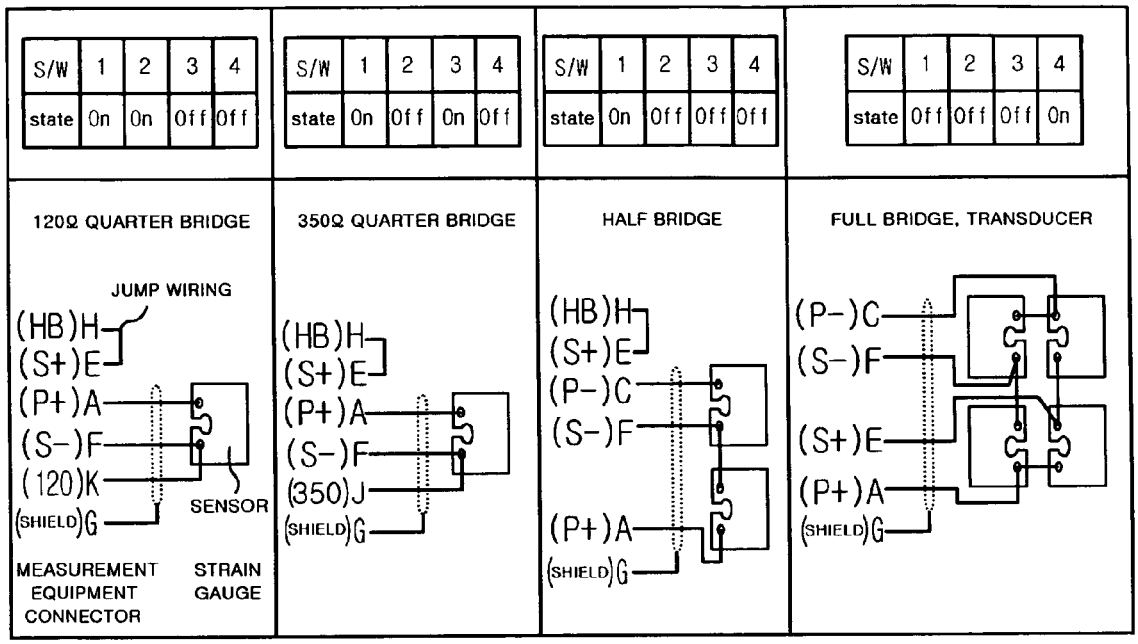
FIG. 3 shows four types of wiring systems that may be performed between the sensor and the measurement equipment in strain gauge-related measurement and is an explanatory view illustrating each selection of wiring system.

In FIGS. 1 to 3, the alphabets H, E, A, F, K, and G at both sides of the cable connector designate the symbols of connector pins 142 of the cable connector connected to the measurement equipment. The alphabets also designate the symbols of electric wires to be connected to corresponding connector pins 142. The connector pins 142 will be eventually connected to the connectors of the measurement equipment (for example, S−, P−, P+, shield, HB, 120Ω, 350Ω, and S+) by means of a commercial connector 140 (refer to FIG. 4).

Furthermore, the signal line of the strain gauge is connected to the sensor connector of the cable connector according to an embodiment of the present invention.

FIG. 2 is a view showing FIG. 1 as a circuit diagram in order to help the understanding of the cable connector according to an embodiment of the present invention.

The wiring state will be described below with reference to FIG. 2. The electric wires F, C, A, and G of the sensor connector are connected directly to the pins 142 (F, C, A, G) of the commercial connector 140, respectively. Furthermore, the remaining one electric wire of the sensor connector, which is indicated by "H, K, J, E", is not connected directly to the connector pins 142, but is connected commonly to second, third, and fourth terminals 124 of the DIP switch 120.

Therefore, the electric wire may be selectively connected to H, J, K or E of the connector pins 142 by manipulating the second, third, and fourth terminals 124 of the DIP switch 120. In addition, a jump wiring 130 is used to determine whether the H and E terminals of the connector pins 142 has been jumped by manipulating the first switch control unit 122 of the DIP switch 120.

For example, in order to implement a 120Ω quarter bridge wiring of FIG. 3, it can be seen that the terminals H, E of the connector pins 142 must be interconnected by the jump wiring 130, three signal lines of the strain gauge of the sensor connector must be eventually wired to the connector pins 142 (A, F, and K) of the commercial connector 140 respectively, and the shield should be connected to the connector pins 142 (G).

Therefore, it can be seen that for such a wiring, the first and second switch control units 122 must be turned on and third and fourth switch control units 122 must be turned off in the DIP switch 120 of FIGS. 1 and 2, and in wiring of the sensor connector, three signal lines of the strain gauge must be connected to the electric wires 100 (A, F, and K) respectively.

Furthermore, for example, in order to implement the wiring of a 350Ω quarter bridge of FIG. 3, it can be seen that the first and third switch control units 122 must be turned on and the second and fourth switch control units 122 must be turned off in the DIP switch 120 of FIGS. 1 and 2.

In this case, when the first switch control unit 122 of the DIP switch 120 is turned on, the terminals H, E of the connector pins 142 are jump-wired, and only the third of the second to fourth terminals of the switch control unit 122 is turned on. Therefore, the electric wires 100 of the sensor connector, which are indicated by H, K, J, E, are wired by the terminal J of the connector pins 142 and is eventually connected to the 350Ω terminal of the measurement equipment. Then the three signal lines of the sensor connector are wired to the terminals A, F, and J, the 350Ω quarter bridge wiring of FIG. 3 is completed.

There is shown in FIG. 3 the state of the DIP switch 120 that selectively switches predetermined four kinds of sensor signal line wirings, such as the four kinds of wirings (the 120Ωquarter bridge, the 350Ω quarter bridge, the half bridge, and the full bridge or full bridge transducer wirings) that may be selectively used.

In this case, the wiring of the 120Ω quarter bridge wiring and the 350Ω quarter bridge can be performed simply only through mechanical manipulation of the DIP switch 120 without artificial wiring.

Furthermore, for the purpose of implementing the half bridge and the full bridge, a minimal artificial wiring work is inevitable. As a result, the four kinds of the wiring systems shown in FIG. 3 can be all selectively implemented through the manipulation of the switch and minimal artificial wiring change.

Figure 4:
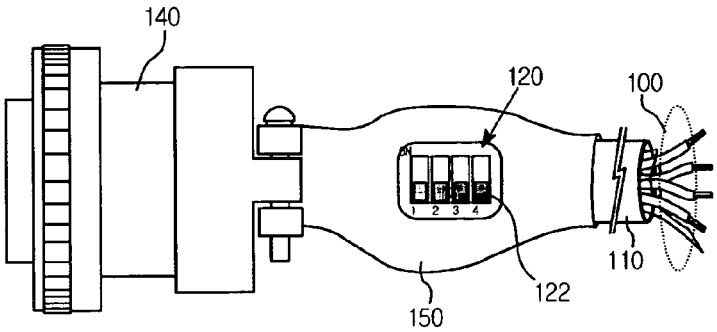
FIG. 4 is a perspective view of the cable connector according to an embodiment of the present invention, which is covered with a heat shrinkable tube, has a DIP switch fixed thereto.

Meanwhile, FIG. 4 shows an example of a completed cable connector according to an embodiment of the present invention, wherein the connector pins 142 shown in FIG. 1 are assembled in the commercial connector 140, and portions of the DIP switch 120 and the cable 110 are covered with a heat shrinkable tube 150 while fixing the DIP switch 120 so that the switch control unit 122 is exposed to the outside through a window.

A wiring arrangement can be switched simply through the manipulation of the jump wiring 130 or the switch control unit 122 by mixing the selection of wirings by the DIP switch 120. Accordingly, there is an advantage in that a wiring system, which is likely to become complicated due to the related art artificial jump wiring, can be simplified.

Furthermore, according to the present invention, a multipurpose cable connector in which wiring can be switched in various ways can be implemented. Accordingly, materials, an installation cost, and wiring work load can be reduced in the wiring system. The work efficiency can be enhanced through the simplification of the wiring system.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A strain gauge interfacing cable connector which selectively connects terminals or connecting pins of a measurement equipment with terminals or connecting pins of a strain gauge sensor, said measurement equipment being compatible with four types of interfacing wiring, 120Ω quarter bridge wiring, 350Ω quarter bridge wiring, half bridge wiring, and full bridge wiring, said strain gauge interfacing cable connector comprising:

a DIP switch having 4-pole switching mode, a cable containing seven electric wires, all one ends of which are connected with terminals or connecting pins of the measurement equipment via a commercial connector, four other ends of which are connected with equipment-side four switching poles or terminals of the DIP switch respectively, and three other ends of which are connected with three terminals or connecting pins of the strain gauge sensor respectively;

an electric wire contained in said cable, one end of which is commonly connected with second, third and fourth sensor-side switching poles or terminals of the DIP switch in a way of parallel connection, and the other end of which is connected with a terminal or pin of the strain gauge sensor;

a jump wire contained in said cable, one end of which is connected with equipment-side fourth terminal or pole of the DIP switch and the other end of which is connected with sensor-side first terminal or pole of the DIP switch, whereby the DIP switch can be manipulated to select one of the four types of interfacing wiring; and a shield wire contained in said cable, one end of which is connected with a shield terminal or pin of the measurement equipment, and the other end of which is connected with a shield terminal or pin of the strain gauge sensor.

* * * * *